US006456311B1

(12) United States Patent
Harush et al.

(10) Patent No.: US 6,456,311 B1
(45) Date of Patent: Sep. 24, 2002

(54) AUTOMATIC REGISTRATION AND LENGTH ADJUSTMENT

(75) Inventors: Shlomo Harush, Nes-Ziona; Yevgeny Korol, Rehovot; Lior Lewintz, Pardes Hana, all of (IL); Omer Gila, Cupertino, CA (US)

(73) Assignee: Indigo N.V., Maastricht (NL)

( * ) Notice: Subject to any disclaimer, the term of this patent is extended or adjusted under 35 U.S.C. 154(b) by 0 days.

(21) Appl. No.: 09/889,066

(22) PCT Filed: Dec. 8, 1999

(86) PCT No.: PCT/IL99/00668

§ 371 (c)(1),
(2), (4) Date: Jul. 6, 2001

(87) PCT Pub. No.: WO00/43206

PCT Pub. Date: Jul. 27, 2000

(30) Foreign Application Priority Data

Jan. 24, 1999 (WO) ..... PCT/IL99/00042

(51) Int. Cl.[7] ..... G03L 15/01
(52) U.S. Cl. ..... 347/116; 101/181; 399/301
(58) Field of Search ..... 347/116; 399/299, 399/301; 101/181, 211; 250/559.44

(56) References Cited

U.S. PATENT DOCUMENTS 2,768,827 A * 10/1956 Noble ..... 101/181
4,445,125 A 4/1984 Scifres et al.
4,474,422 A 10/1984 Kitamura
4,528,630 A * 7/1985 Sargent ..... 101/181
4,534,288 A 8/1985 Brovman
4,547,038 A 10/1985 Mori
4,796,961 A 1/1989 Yamada et al.
4,916,547 A 4/1990 Katsumata et al.
5,076,163 A 12/1991 Sainio
5,315,321 A 5/1994 Peled et al.
5,550,625 A 8/1996 Takamatsu et al.
6,065,400 A * 5/2000 Van Weverberg ..... 101/181

FOREIGN PATENT DOCUMENTS

EP 0 291 738 11/1988
EP 0 744 669 11/1996

* cited by examiner

*Primary Examiner*—Joan Pendegrass
(74) *Attorney, Agent, or Firm*—Fenster & Company Patent Attorneys Ltd.

(57) ABSTRACT

A method for registration of print separations in a printer comprising: (a) printing a first pattern, for which at least one image characteristic varies relatively weakly with misregistration, using at least one of first and second separations; (b) printing a second pattern, for which said at least one image characteristic varies relatively strongly with misregistration, using said at least one first and second separations; (c) determining said at least one image characteristic for the first and second patterns; and (d) correcting the mutual registration of said at least one first and second separations responsive to a difference in the determined at least one image characteristic for the first and second patterns.

38 Claims, 7 Drawing Sheets

AUTOMATIC REGISTRATION AND LENGTH ADJUSTMENT

RELATED APPLICATIONS

The present application is a U.S. national application of PCT/IL99/00668, filed Dec. 8, 1999.

FIELD OF THE INVENTION

The present invention relates in general to optical imaging on a moving surface and in particular to automatic registration adjustments of optical images on the moving surface,

BACKGROUND OF THE INVENTION

Optical imaging on a moving surface is well known, for example in laser printers and photocopiers, wherein optical information is imaged or written on the surface of a photoconductive drum. Normally, optical information is written onto the surface of a drum using stationary optics together with moving optics such as a polygon, a hologon or a galvano-mirror to axially scan the drum. U.S. Pat. Nos. 4,796,961; 4,547,038; 4,445,125 and 4,474,422, 5,315,321, which are incorporated herein by reference, describe such optical imaging systems.

When multicolor optical information is to be imaged or written, a final compound color is obtained, in general, by superimposing print separations. Each print separation has a different basic color, and the color separation prints are coordinated with and aligned relative to each other. In general a plurality of dots or patches, each of different basic colors, are printed in a same locality so as to be aligned with or superimposed on each other. Such superposition of print separations gives the impression of a full color image having colors that may be different from the basic colors.

Normally three or four separations are used, each with a basic color, (or optionally, black) in order to obtain a final compound color. In some cases additional color separations are also used. The final compound image is obtained by finely adjusting, through alignment of the system, the position of each separation, to accurately overlay the separation prints. The alignment process and the alignment itself are called registration.

When the separations are printed slightly out of registration, the appearance of an image is slightly impaired. However, if the separations are more than slightly out of registration, the effect will be disturbing to an observer. In particular, the individual edges of objects formed by each one of the separations will separate and the quality of the final multicolor image will be greatly impaired.

In order to have substantially perfect registration, the imaging system is finely tuned and adjusted prior to a printing task by performing several registration iterations until the result is judged acceptable. In practical systems, registration is usually performed by superimposing a plurality of separations of predetermined pattern(s) and visually checking the patterns for alignment. The results of the registration are only qualitative and depend on the skill of the person who visually checks the degree of coincidence of the separations and adjusts the printer.

In addition, applicants have found that for some methods of printing digital images, the apparent scale of the different color images on the final substrate may vary from separation to separation, even if they are all the same size on an image forming surface on which they are formed. This results, at best in a composite image in which at least some of the separations are misregistered over at least a portion of the image.

SUMMARY OF THE INVENTION

An object of some preferred embodiments the present invention is to provide a method and apparatus for performing image registration, preferably automatically, in an optical imaging system, for example, in a laser printing or a photocopying system.

An object of some preferred embodiments of the invention is to provide a method and apparatus for determining an amount of image scaling between the various separations, preferably automatically, for example, in a laser printing or photocopying system.

In accordance with a preferred embodiment of the present invention, at least two separations of a predetermined shape are printed in the same color to form a first pattern. This pattern is configured such that misregistration of the separations changes one or more measurable characteristics of the pattern. According to preferred embodiments of the invention, these characteristics include one or more of a print shape characteristic and an average color density of first printed pattern. The resulting print is compared to a second pattern, preferably printed together with the first pattern, whose characteristics, (e.g., shape and/or average color density) are not dependent on misregistration of the separations. The second pattern is preferably printed utilizing both separations although, in some preferred embodiments of the invention, a single separation is used to print the second pattern.

Preferably, the first pattern and the second pattern have the same average color density when the separations are registered. Preferably the average color density (or factors derived from the average color density) of the first and second patterns are compared to estimate the extent of the misregistration. In a preferred embodiment of the invention, the system registration is corrected by this estimated misregistration.

Alternatively, the first and second patterns have a characteristic distance. The characteristic distance for the first separation is not affected by misregistration of the separations and the characteristic distance for the second pattern is affected by misregistration.

In a preferred embodiment of the invention, a second print of the separations is performed with the corrected alignment and this print is checked for misregistration, which is then corrected. Preferably, additional iterations are performed until the misregistration is below a predetermined value.

After a first pair of separations is registered, one of the registered separations is preferably registered with a third separation, in the same manner as described above. Preferably, the third separation is adjusted in the registration process, so that after the second registration all three of the separations are mutually registered. This process is repeated until all of the separations used for printing are mutually registered.

In preferred embodiments of the invention, the same color is used to print all the separations, during registration, even though different colors will be used when the final image separations are printed.

A similar system is used to determine and correct for scale variations between sequential separations. One way in which such variations can occur is when the dimensions of the substrate change between sequential transfer of the separations to it. For example if the transfer process utilizes heat then the substrate dimensions will vary with successive transfers, since the substrate is heated (up to some temperature) by each of the transfers. In addition, for systems that use wet toners or inks, the wetting of the substrate may cause a change in dimension.

In order to determine scale changes a series of patterns (as described above) are printed along the length and/or along the width of the substrate. The offset of the separations is determined as a function of the length (or width) and a best fit for the function is determined. This best fit will be of the form: $\delta(z)=a+bz$. The coefficient "a" gives the required offset or misalignment correction and the factor "D" gives a scale correction which is applied to the data The scale and offset corrections can be applied to digital data, when the apparatus is a digital printer or may be applied as a magnification and offset if the data is in analog for, as in a copier.

It should be understood that the above process is most easily applied for certain system types. In one such system, a single photoreceptor is used to separately form latent electrostatic images of the various separations. The individual separations are developed using different color toners and the developed separations are transferred to substrate, either directly or via an intermediate transfer member. In many cases, the toners may be liquid toners and/or the intermediate transfer member may be heated, which may be among the causes of the misalignment/scale problem.

In registering such a system, in accordance with preferred embodiments of the invention, two latent images corresponding to separations as described above are formed and developed with the same toner material to form the images described above. This results in a single color image for both patterns. This color may be any of the available colors, used in the print.

In other systems, the various separations can not be formed in the same color. Such systems include systems in which separations are printed in tandem with different print engines. These may be electrophotographic systems, other electrographic systems, or even ordinary plate printing systems. Other such systems include systems for which separations are printed on the same print engine by changing printing plates or masters. Such systems are generally ordinary printing plate or printing master systems.

For these systems, the at least two separations may be printed with different colors. When different colors are used in a registration procedure, preferably, a spectral region common to said colors and preferably a spectral region at which the two colors absorb light equally, is first identified. Then the registration procedure is performed, utilizing light in the identified spectral region. Preferably, the measurements are performed using an optical filter that rejects substantially all the wavelengths outside the identified spectral region. This region may be within the normal color extent of the colors or may be in the infra-red or ultra-violet, if the visible color extents do not overlap. In some preferred embodiments of the invention an additive which is transparent in the visible, but absorbing in the UV or infra-red may be added to the irks.

One aspect of the method and apparatus provided in accordance with some preferred embodiments of the present invention, relates to obtaining quantitative information responsive to a degree of a registration (or misregistration) and/or scale differences of optical imaging systems such as, for example, printing or photocopying systems.

In some preferred embodiments of the present invention, an average optical density (OD), is measured for both the first and second patterns. From the measured OD values, dot areas (DA) are preferably computed and then compared. The amplitude of the computed DA values indicates the direction and sign of the misregistration and indicates the direction and magnitude of the correction required.

In order to determine scale changes a series of patterns (as described above) are printed along the length and/or along the width of the substrate. The offset of the separations is determined as a function of the length (or width) and a best fit for the function is determined. This best fit will be of the form: $\delta(z)=a+bz$. The coefficient "a" gives the misregistration or misalignment and the factor "b" gives a scale error.

In a preferred embodiment of the present invention, the optical density is measured by a densitometer. More preferably, the densitometer is operated, in line with the imaging system, during the registration, so as to measure in real time the optical density of an overlap produced on the test sheet.

Alternatively, the average optical densities measured over the first and second patterns are used for registration purposes without computing a DA. The measured average OD values are then compared and the direction and amount of the misregistration (and correction) is estimated.

If the difference between the measured average OD values or DAs for the two patterns is within a given range (corresponding to a given misregistration), the registration of the optical imaging system is judged acceptable. Similarly, when scale and misregistration is to be corrected, all of the patterns should be within the range. Otherwise, the registration and/or scaling operation is iteratively performed until the desired registration and/or scaling accuracy is achieved (or the registration and/or scaling fails to meet a convergence criteria).

An aspect of the method and apparatus provided in accordance with some preferred embodiments of the present invention, relates to independently determining the registration and scale error relative to one separation for each of the other separations. Preferably, the registration and/or scale is optimized for each one of the separations in order for the imaging system to have an acceptable registration and/or relative scale level.

There is thus provided, in accordance with a preferred embodiment of the invention, a method for registration of print separations in a printer comprising:

(a) printing a first pattern, for which at least one image characteristic varies relatively weakly with misregistration, using at least one of first and second separations;

(b) printing a second pattern, for which said image characteristic varies relatively strongly with misregistration, using said first and second separations;

(c) determining at least one image characteristic for the first and second patterns; and (d) correcting the mutual registration of the first and second separations responsive to a difference in the determined at least one characteristic for the first and second patterns.

Preferably, the method includes repeating at least (b)–(d) for a third separation in place of said second separation.

In a preferred embodiment of the invention, the first pattern is printed utilizing both said first and second separations.

In a preferred embodiment of the invention the characteristic is a dot area.

In a preferred embodiment of the invention the characteristic is a hue.

In a preferred embodiment of the invention the dot area is determined from a measurement of optical density.

In a preferred embodiment of the invention the characteristic is an average optical density of the pattern.

In a preferred embodiment of the invention the first pattern is printed using only one separation.

Preferably, the first and second separations are printed in a same color. Alternatively, the first and second separations are printed in different colors.

In a preferred embodiment of the invention the characteristic is an extent. Preferably, the first pattern comprises a series of lines having a given spacing pattern printed using said first separation and wherein said second pattern comprises a series of lines having said given spacing pattern and wherein, in the absence of misregistration, some of said fines being printed utilizing said first separation and some of said lines being printed utilizing said second separation.

In a preferred embodiment of the invention the characteristic of the first pattern does not vary with misregistration.

Preferably, the first pattern comprises at least one first rectangle printed by said first separation and having a given extent and at least one second rectangle printed by said second separation having a smaller extent than said first rectangle in at least one direction, said second at least one rectangle being completely within the first rectangle, such that the characteristic is not a function of misregistration of the separations; and the second pattern comprises at least one, third, rectangle printed by said first separation and at least one, fourth, rectangle printed by said second separation partially overlapping said third rectangle, the extent of said partially overlapping rectangles having said given extent when the separations are registered.

In a preferred embodiment of the invention, the first pattern comprises at least one first rectangle printed by said first separation having a first given extent and at least one, second, rectangle printed by said second separation having said first given extent partially overlapping said first rectangle, the extent of said partially overlapping rectangles providing a pattern for which said characteristic varies relatively weakly with misregistration of the separations; and the second pattern comprises at least one, third, rectangle printed by said first separation and at least one, fourth, rectangle printed by said second separation partially overlapping said third rectangle, the extent of said partially overlapping rectangles providing the same value of the characteristic as for the first pattern when the separations are registered, wherein the extent of the third and fourth rectangles is much smaller than first given extent, such that the characteristic of the second pattern is much more sensitive to misregistration than is the first pattern.

In a preferred embodiment of the invention, the method includes:

identifying a spectral region for which said different colors have a substantially equal absorption; and utilizing a characteristic of said patterns in said spectral region in registering the separations.

Preferably the method includes printing a plurality of said patterns and utilizing an average value of the characteristic in correcting the registration.

Preferably, the method includes printing a plurality of said patterns;

determining a functional fit to variations in said characteristics; and utilizing a zeroth order term in said functional fit to correct the registration In a preferred embodiment of the invention, correcting said alignment includes correcting scale differences between the separations, and including utilizing a variation in said characteristic in correcting scale differences between the patterns.

In a preferred embodiment of the invention, correcting said alignment includes correcting scale differences between the separations and including printing a plurality of said patterns and utilizing a variation in said characteristic in correcting scale differences between the patterns.

Preferably, the variation used to correct scale is a first order variation of the characteristic.

Preferably, the first and second patterns comprise a plurality of repeating sub-patterns and wherein an average value of said characteristic over the extent of the pattern is utilized in correcting the registration.

In a preferred embodiment of the invention the printer prints said separations without a change of printing plates.

In a preferred embodiment of the invention the printer is an electrostatic printer. Preferably, the electrostatic printer is an electrophotographic printer.

Preferably, the printer utilizes liquid toner to print. Alternatively, the printer utilizes powder toner to print.

In a preferred embodiment of the invention, an intermediate transfer member is utilized to transfer the separations between an image forming surface on which the separations are formed and a substrate. Preferably, the intermediate transfer member is heated.

In a preferred embodiment of the invention, the patterns are used only for registration and are not printed together with an image for which registration is desired.

In a preferred embodiment of the invention the registration serves to align the printer and wherein subsequent images, different from the patterns, are printed with the same printer alignment.

In a preferred embodiment of the invention the printer uses dedicated plates for each separation. Preferably, the printer utilizes printing ink to print the patterns.

In a preferred embodiment of the invention a same printing engine is used to print the separations. Alternatively, different printing engines are used to print the separations.

In a preferred embodiment of the invention the method includes:

repeating at least (a)–(c) after correcting the alignment in accordance with (d), preferably, until said difference is below a given value.

BRIEF DESCRIPTION OF FIGURES

The invention will be more clearly understood by reference to the following description of preferred embodiments thereof read in conjunction with the accompanying figures. Identical structures, elements or parts that appear in more than one of the figures are labeled with the same numeral in all the figures in which they appear.

DETAILED DESCRIPTION OF PREFERRED EMBODIMENTS

Figure 1A:
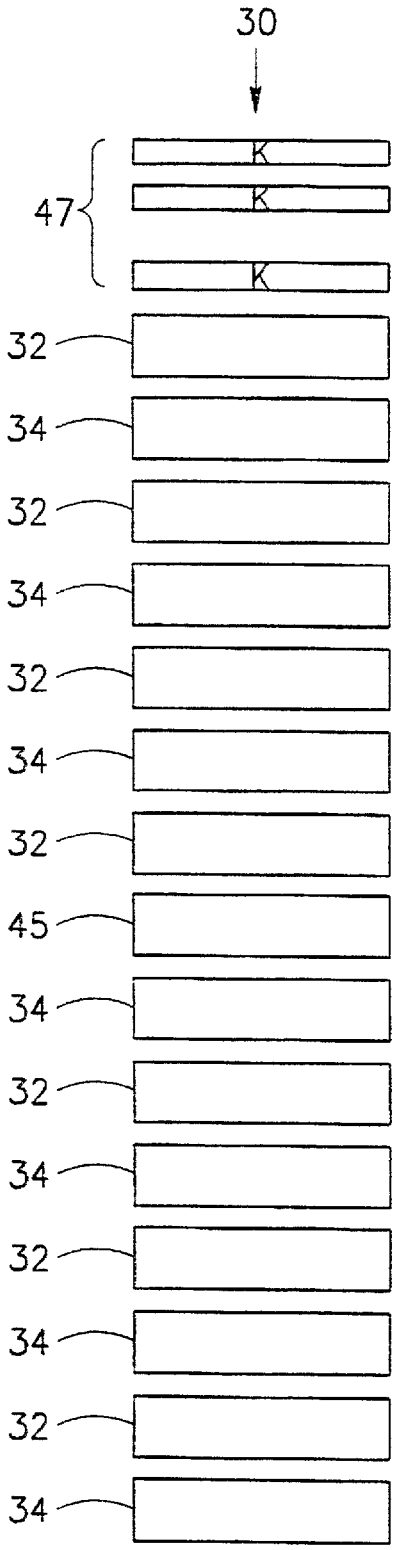
FIGS. 1A and 1B schematically show two prints having various print regions, useful for carrying out a registration method in accordance with a preferred embodiment of the invention.

Reference is now made to FIG. 1A, which schematically shows a print 30 in which various regions are printed in accordance with a preferred embodiment of the invention.

Figure 1B:
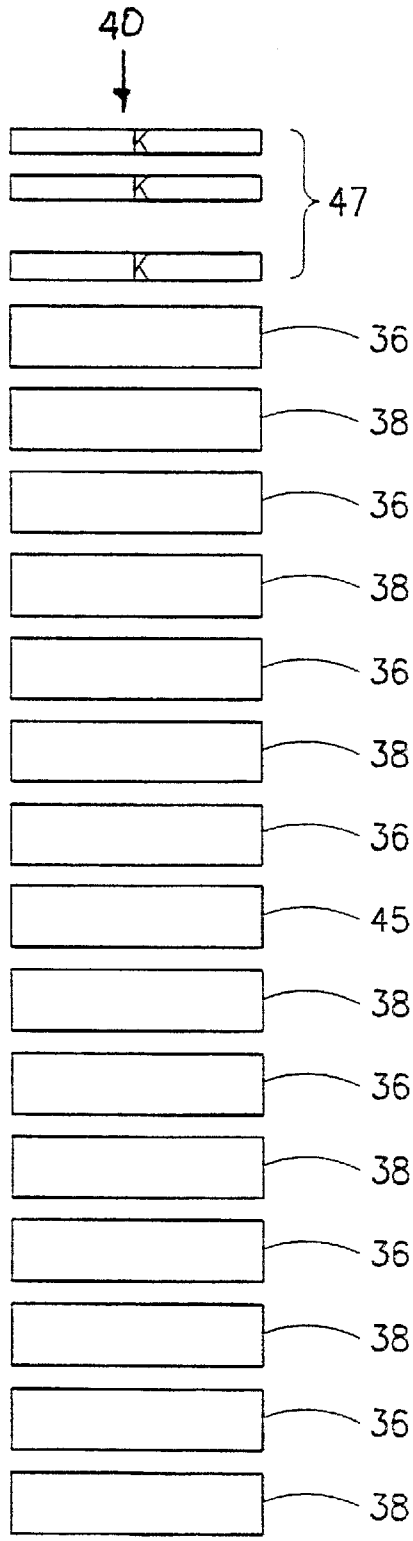

Print 30 comprises a plurality of regions 32 and 34, which are used to determine and correct the registration between a first, reference, separation, and a second separation. FIG. 1B shows a second print 40 in which regions 36 (together with information from region 34) are used to determine and correct the registration between a third separation and the reference separation and regions 38 (together with information from region 34) are used to determine and correct the registration between a fourth separation and the reference separation.

Since the alignment of each of the separations with the reference separation is similar, only one of the procedures will be described in detail, namely the registration first pair of separations, using regions 32 and 34.

Figure 2A:
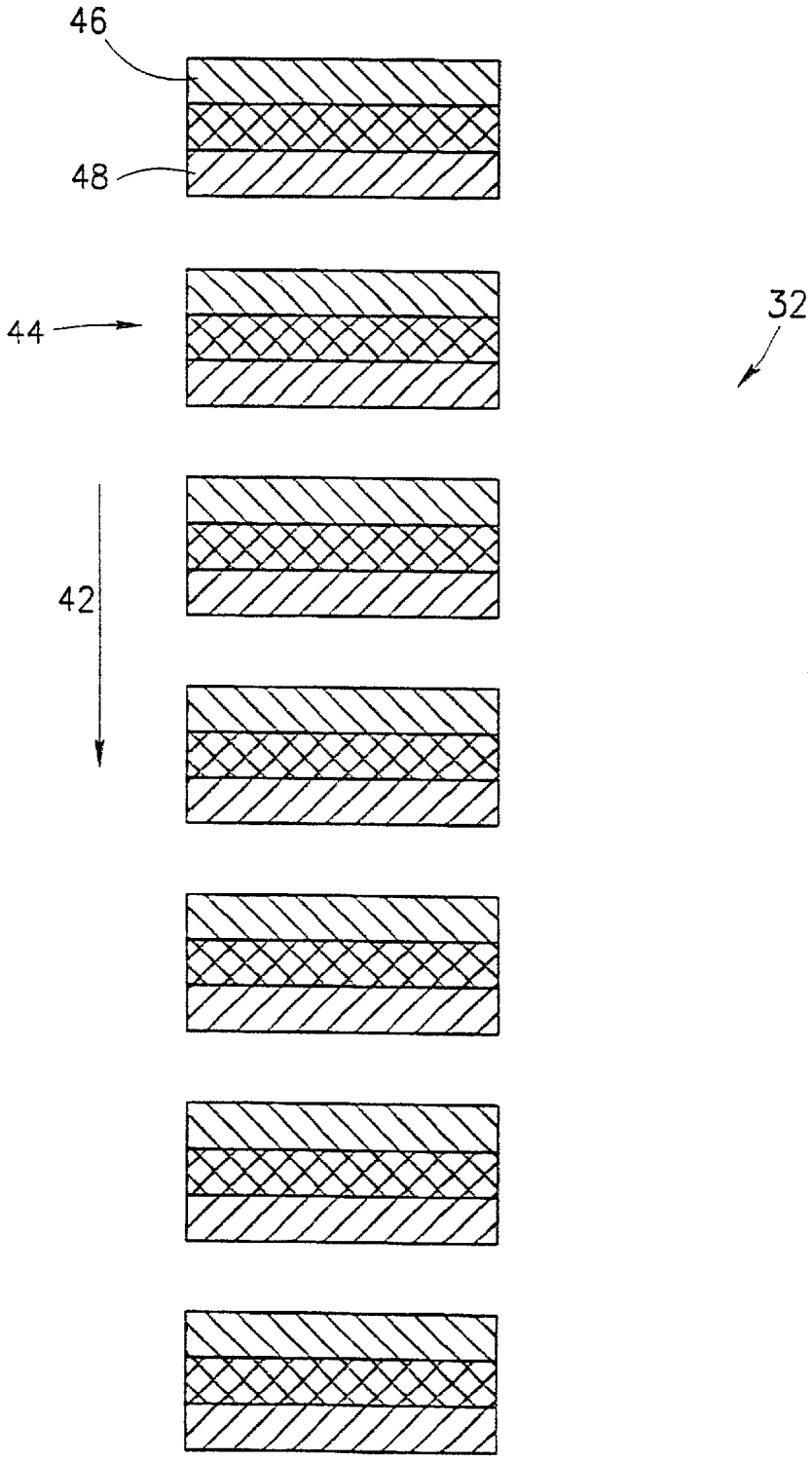
FIGS. 2A and 2B show schematically the print patterns in two of the regions of FIG. 1A, printed in accordance with a preferred embodiment of the invention.

Region 32 comprises a series of preferably solidly printed areas 44 as shown in FIG. 2A. A portion of the printed area printed with the first separation is marked with reference numeral 46 and a portion printed with the second separation is marked with reference numeral 48. Printed portions 46 and 48 are marked with oppositely oriented diagonal lines, such that regions printed with both separations are shown as cross hatched.

Figure 2B:
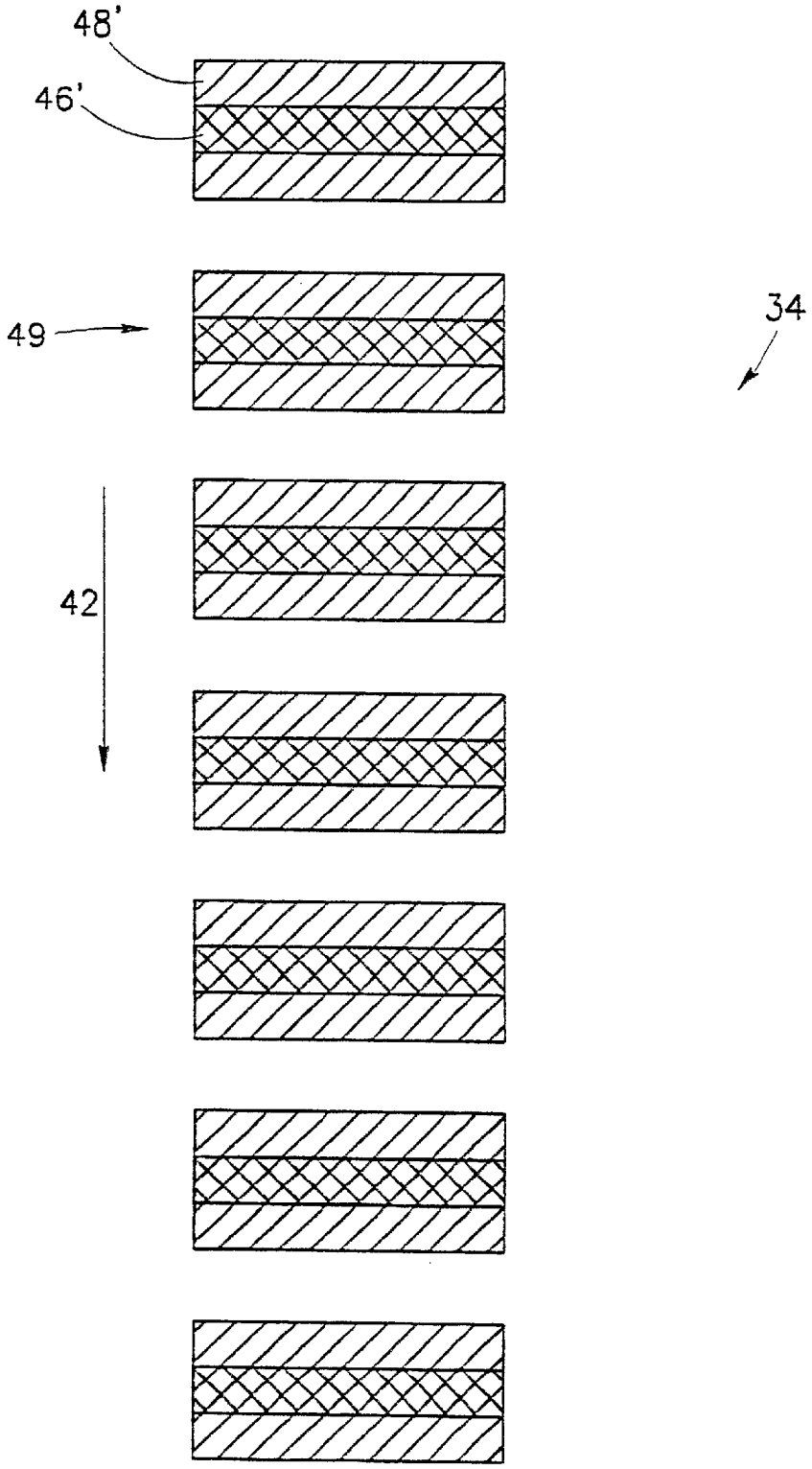

Region 34 comprises a series of printed areas 49 as shown in FIG. 2B. The entire printed area is printed with the first separation indicated by reference numeral 48' and marked with the same diagonal marking as in FIG. 2A. The second separation prints only a small strip 46' in the center of the print portion 48'. Strip 46' is marked with the same diagonal marking as in FIG. 2B. However, since it overlays the print of the first separation, it is shown as cross-hatched on FIG. 2B.

In a preferred embodiment of the invention, both separations are printed in the same color. A comparison of the prints of FIGS. 2A and 2B shows that, when there is no misregistration between the separations, they are the same, the only difference between them being the way the pattern is formed. Alternatively, the measurement is made in a spectral region in which the inks have the same density.

If, however there is misregistration in the print direction (shown as arrow 42), the area of the prints is different, with the sign of the difference being dependent on the direction of the misregistration. This difference is proportional to the amount of the misregistration. A computation of dot area based on a measurement of average density will be roughly proportional to the actual total printed area and thus to the misregistration.

In general, the dot area (actually percent print) is computed using the formula:

$$DA_S = \frac{1 - 10^{-(OD_S - OD_B)}}{1 - 10^{-(OD_F - OD_B)}}$$

where $DA_S$ is the effective dot area of a test or reference region 32 or 34 (as shown in FIG. 1A) and $OD_S$ is the average optical density of the region (measured over the printed and non-printed areas). $OD_B$ is the optical density of the background (i.e., of the paper on which the image is printed). This may be measured on the areas between the regions. $OD_F$ is the optical density of a completely printed region, such as a region 45 on FIG. 1. As a practical matter, the dot area used for the determination of the misregistration is the average dot area measured over all like solidly printed areas and intervening unprinted spaces.

If the system is correctly aligned, the computed DA is the same for regions 32 and 34. However, if misregistration at the position of 32 and 34 is present, the computed DA is different for the two regions, with the sign of the difference being indicative of the direction of the misregistration. The amount of the difference is approximately proportional to amount of the misregistration, with the proportionality being determined by the geometry of the printed areas.

In general, for laser or other systems in which information is written line by line, the misregistration to be corrected is system misregistration and not misregistration in the data itself Thus, the present registration system acts to correct for system misalignments which lead to misregistration of the separations. In a preferred embodiment of the invention, the patterns shown in FIGS. 1 and 2 are printed separately from the actual images to be printed and the system is aligned. After the system is aligned, any separations which form actual desired images will be aligned as well. When the printing system is misaligned, gross realignment of the system may be achieved by offsetting the data which is scanned to form the various separations by one or more lines. However, for high quality printing the resulting ±0.5 line accuracy is not sufficient.

Alternatively to printing the reference pattern with two separations, if a high density color (such as black) is utilized, the reference pattern may be printed with only one separation. Accuracy of the alignment is believed to be only minimally affected. If scale differences between the separations are present, it will be impossible to align the system over the entire length of the print. In order to effect such alignment, a scale change of the data between the separations must be determined. To determine scale errors the offset of the separations is determined as a function of the length (or width) and a best fit for the function is determined. This best fit will be of the form: $\delta(z)=a+bz$. The coefficient "a" gives the required offset or misalignment correction and the factor "b" gives a scale correction which is applied to the data. Preferably, the zero of "z" is set at the center of the page, to minimize changes in scale an offset to a minimum. The scale and offset corrections can be applied to digital data, when the apparatus is a digital printer or may be applied as a magnification and offset if the data is in analog for, as in a copier.

Figure 3A:
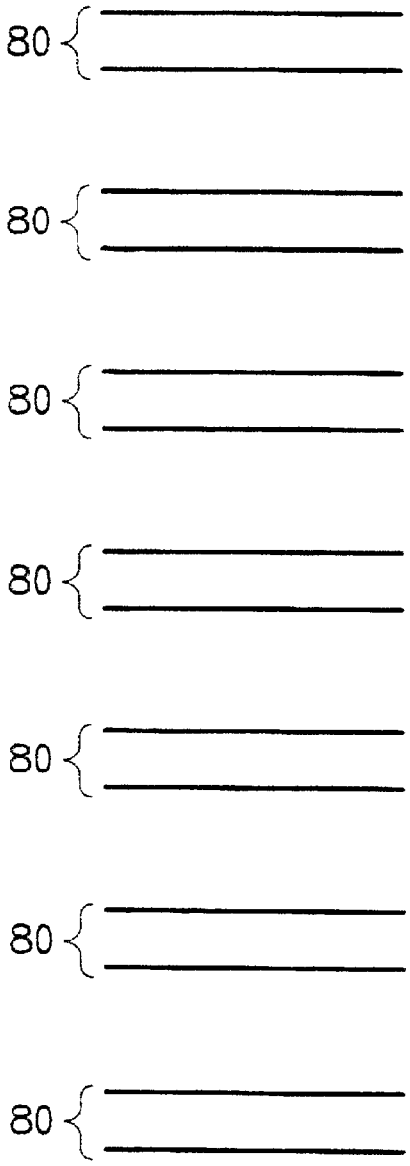
FIGS. 3A and 3B schematically show two alternative patterns, useful for carrying out registration in accordance with a preferred embodiment of the invention.

FIGS. 3A and 3D show reference and misregistration sensitive patterns useful in a second preferred embodiment of the registration method of the invention.

The pattern of FIG. 3A comprises thin line pairs 80 that are printed with a single separation. The spacing within each line pair is the same and the spacing between line pairs is also the same. Preferably, the spacing within a pair is different from the spacing between pairs.

Figure 3B:
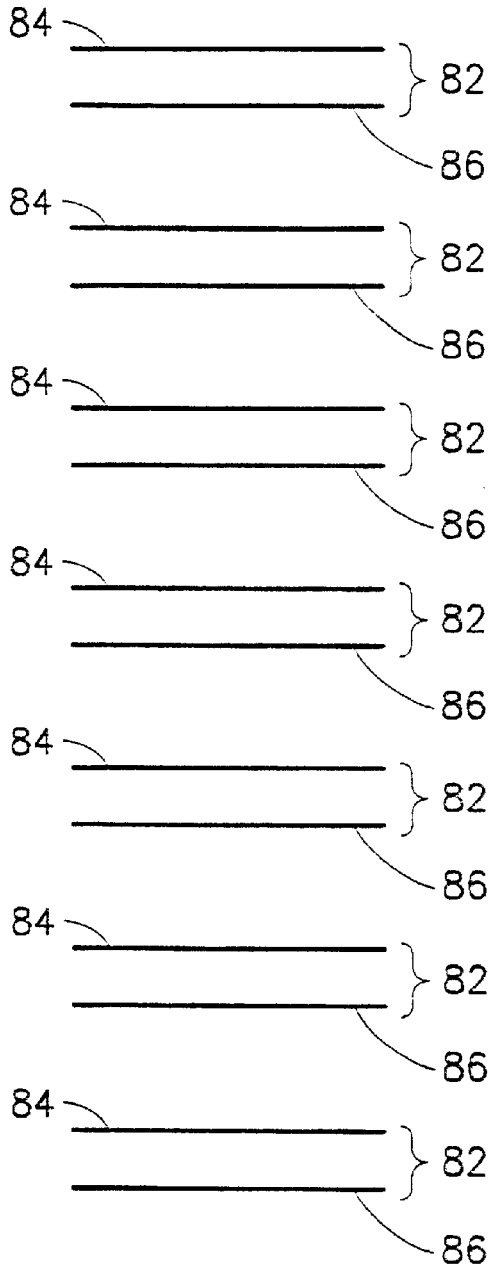

The pattern of FIG. 3B comprises thin line pairs 82 that appear identical to those of FIG. 3A. However, alternating lines (84 and 86) are printed utilizing different separations. Thus the spacing between lines in a pair and the spacing between pairs will depend on misregistration between the separations.

A simple measurement of the distances (for example using the output of an on-line detector) allows for the determination of the center to center distance between the lines. Differences between the distances measured for the patterns of FIGS. 3A and 3B indicate not only the amount of the misregistration, but also its direction. Since a number of line pairs of each type are present in each pattern and since a number of patterns of each type are printed, quite high accuracies can be achieved if the distance measurements are averaged. In a similar manner to that described above for FIG. 2, the scale can also be determined.

Figure 4:
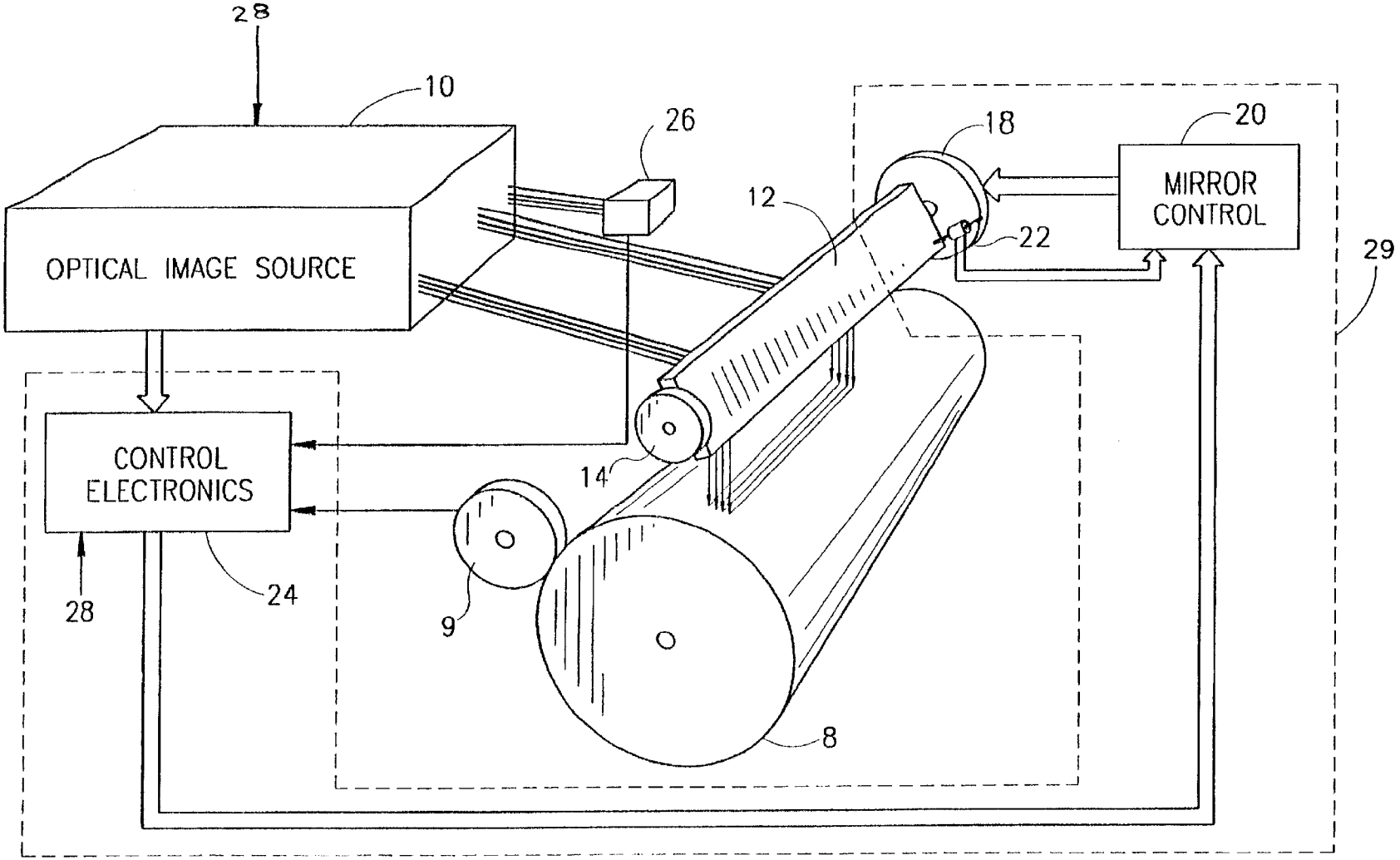
FIG. 4 schematically shows a portion of an electrographic system suitable for registration utilizing a registration method of the present invention.

FIG. 4 shows a printer system, based on that described in U.S. Pat. No. 5,315,321 (which is incorporated herein by reference), which system makes registration and scale corrections to an accuracy better than a scan line. To the extent that elements in FIG. 3 are not described in the present application, the reader is referred to that patent for further details. The system of FIG. 4 as described in this patent corrects for variations in the rotation velocity of a photoreceptor 8 by angular adjustment of a galvano-mirror 12. In general, an optical image source 10 sends a timing signal to control electronics 24 which also receives a signal from an encoder 9 and an end-of-line sensor 26. Controller 24 controls the position of mirror 12 utilizing a mirror control 20 to adjust the position of the scanning beam on photoreceptor 8 such that the beam is correctly positioned on the photoreceptor. Since adjustment of mirror 12 can be finer than a single line of the scan, the alignment of the beam can be finer as well. In a preferred embodiment of the invention, an additional adjustment of mirror 12 is provided by controller 24 responsive to an adjustment signal 28, to adjust for the misregistration measured using the above described method. Furthermore, control electronics 24 may also control the scale of the image being printed either by applying an offset to mirror 12 which is a function of time (via control electronics 24) or by changing the scale of a digital image (via optical image source 10). Scaling algorithms are well known in the art. while the configuration shown in FIG. 4 is preferred, any method useful for correcting alignment and/or scale may be used, especially, if it corrects alignment to better than a single line.

It should be understood that misregistration of greater than one line may be first corrected by shifting data by a whole scan line. Fractional misregistration may then be corrected optically or even mechanically.

Figure 5:
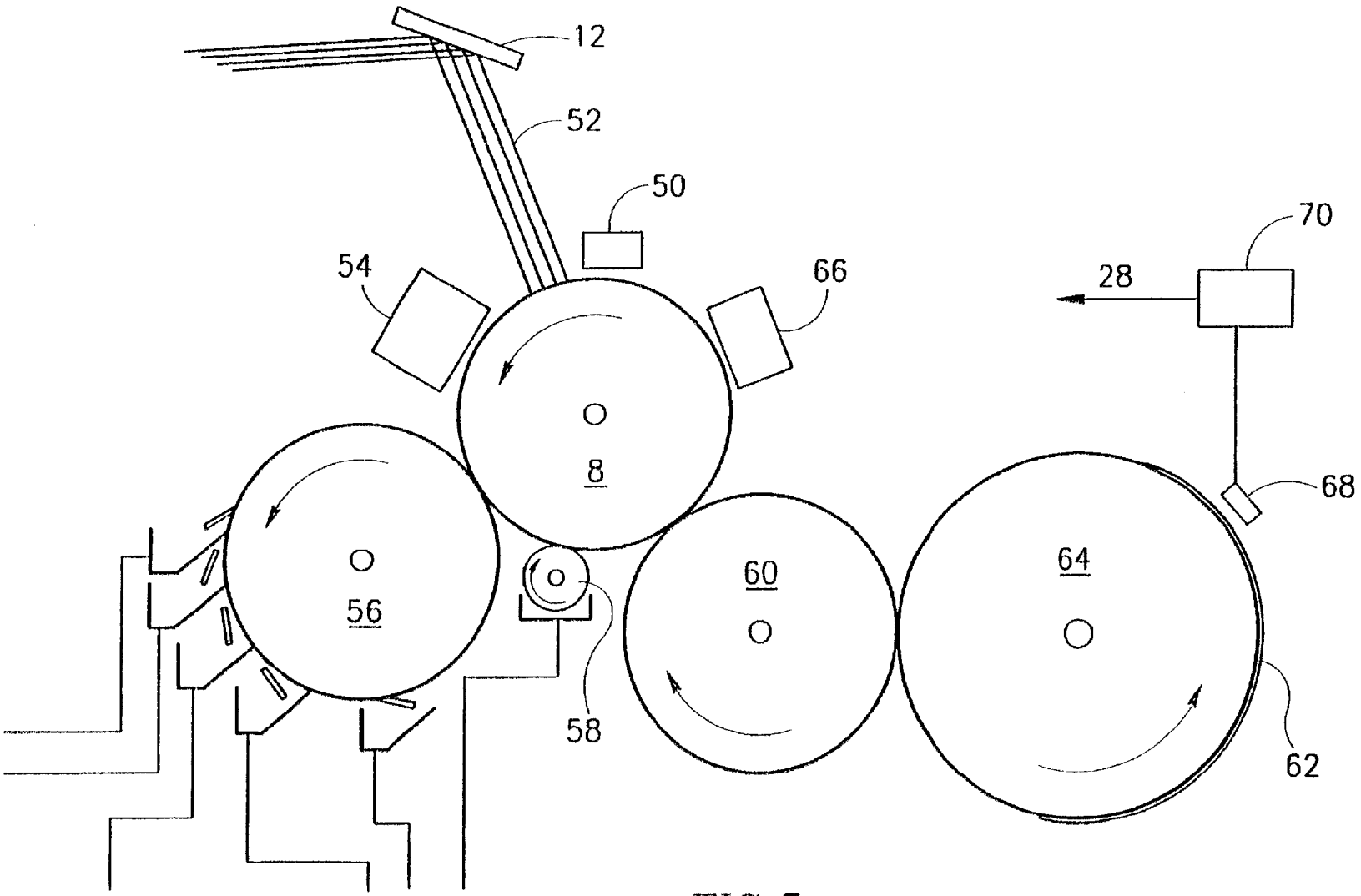
FIG. 5 schematically shows a further portion of an electrographic system suitable for measurement of the misregistration between various separations.

FIG. 5 shows a portion of an electrographic system suitable for determining misregistration of separations in accordance with a preferred embodiment of the invention. FIG. 5 shows a generalized liquid toner electrophotographic printer as is well known in the art. The system shown is only exemplary and is used to illustrate the method of registration and scaling of the present invention. The methodology of the image formation can be any of a wide variety of different available powder or liquid toner systems. In general, the present invention does not appear to be tied to any particular system, although the cause and severity of the problems may depend on the imaging method and particular imaging system.

In accordance with the normal operation of the system shown in FIG. 5, photoreceptor 8 is electrified by a corotron, scorotron or other electrifying means 50. Scanning laser beam or beams 52 (after reflection from mirror 12) impinge on photoreceptor 8 and form a latent image of a particular separation thereon. A dispenser of liquid toner 54, which may be a spray dispenser, a series of spray dispensers or a series of slit dispensers, as known in the art, supply a liquid toner of a color corresponding to the separation. The latent image is developed by the toner to form a visible image on the photoreceptor. A developer roller 56 aids in the development and removes both toner that is not used to develop the image and excess liquid from photoreceptor 8. A series of scraper blades or other means remove this material from developer roller 56 preferably, for reuse. Preferably, a squeegee roller 58 compresses the image and removes excess liquid therefrom, prior to the transfer of the image to an intermediate transfer member 60. The image is then transferred to a sheet 62 held on an impression roller 64.

After transfer of the image to the intermediate transfer member, residual toner and charge on the photoreceptor are preferably removed by discharge and cleaning apparatus 66 which may be any of the many types that are well known in the art.

The separations are written (by the scanning laser), developed and transferred to the sheet, seriatim, in registration. Unfortunately, the registration and/or scaling may not be perfect. Thus, in accordance with a preferred embodiment of the invention, the above described registration procedure is applied.

In a preferred embodiment of the invention, one or more densitometers 68 are placed near the surface of sheet 62 to measure the densities of the special prints used to perform the alignment in accordance with a preferred embodiment of the invention. Alternatively, for the embodiment of FIGS. 3A and 3B, simple optical sensors can be used and their outputs analyzed to determine the line distances. As indicated above, beams 52 write the pattern of a first of the separations shown in FIGS. 1A, 2A and 2B (or 3A and 3B) to form a latent image on photoreceptor 6. This image is developed in one of the colors by elements 54 and 56, as described above. The developed image is transferred to the sheet. Next a latent image corresponding to a second separation is written on the photoreceptor. The latent image is then developed, preferably using the same color developer used to develop the first separation (and not the color of the second separation). This image is then transferred onto the image of the first separation. This results in the printed images shown in FIGS. 2A and 2B (or 3A and 3B). It should be understood that in some preferred embodiments of the invention, the images may be transferred directly to the sheet from the photoreceptor and the intermediate transfer member omitted. Alternatively, both images may be transferred to the intermediate transfer member before they are transferred together to the sheet.

Densitometer 68 performs the density measurements described above and a calculator 70 estimates the correction needed to align and/or scale the separations and sends adjustment signal 28 to controller 24 as described in connection with FIG. 4.

After the position of mirror 12 is adjusted to apply the desired alignment correction the image shown in FIGS. 1A, 2A and 2B (or 3A and 3B) are preferably printed a second time with the corrected alignment. Again the misregistration is measured and the alignment corrected. This procedure is repeated until the measured misregistration is below some predetermined value such as 5 or 10 micrometers.

After one of the separations is registered with the reference separations a second image as shown in FIG. 1B is printed. This image includes patterns 36 and 38, comprising composite prints of third and fourth separations respectively with the reference separation similar to those shown in FIG. 2B (or 3A). This print does not require patterns of the form of that shown in FIG. 2B, since the values of OD and DA for this pattern were determined from the previous print and may be stored in calculator 70. This second print allows for the registration and/or scaling of two more separations with the reference separation, such that all the separations are mutually registered. If more than four separations are used, a third print, similar to that of FIGS. 1A (or 3A) is printed comprising composite prints of a fifth and sixth separations.

In prints printed in accordance with a preferred embodiment of the invention, regions 46 and 48 (FIG. 2A) are each 14 pixels long in direction 42 with a 7 pixel overlap and 11 pixel spacing between printed areas. This results (when alignment is achieved) in a total printed length of 21 pixels separated by a 11 pixel spacing. In FIG. 2B, region 46' is 7 pixels long and region 48' is 21 pixels long. Successive printed regions 48' are separated by a 11 pixel long blank areas. It should be noted that if longer printed areas (and unprinted spaces) are used, the range of measurable misregistration and scaling is increased. However, this results in lower sensitivity and thus, lower accuracy in the alignment measurement. In preferred embodiments of the invention, seven repeats of the printed area are provided in each pattern 32 or 34. Larger or smaller numbers of repeats may also be provided.

In one preferred embodiment of the invention, two or more densitometers (or other optical detectors) 68 are provided and the patterns of FIGS. 1A and 1B are printed side by side. Each of the patterns is scanned by a different densitometer such that the misregistration of both may be measured and registered on the same print.

In some preferred embodiments of the present invention, the in-line densitometer, is for example, the DTP-24 densitometer of X-Rite.

As shown in FIGS. 1A and 1B, in addition to the patterns used for the alignment measurement, a number of solid bars 47 are preferably printed at the beginning of the groups of patterns. These bars comprise a synchronization pattern that provides an indication to computer 70 that the measurement is about to start. Preferably, these bars are printed in black to provide a strong signal, even if the patches themselves are printed in a different color. Alternatively, the bars are printed in the same color as the patterns themselves.

In some systems, it is not possible to print a separation in any color other than the color it is normally printed. Such systems include other electrographic systems, or tandem plate printing presses.

For these systems, the at least two separations may be printed with different colors. This produces little problem when utilizing the patterns of FIGS. 3A and 3B. For the patterns of FIGS. 2A and 2B, when different colors are used in a registration procedure, preferably, a spectral region common to said colors and preferably a region at which the two colors absorb radiation equally, is first identified. Then a set of measurements is performed, as described above, limited to identified spectral region. Preferably, the measurements are performed using an optical filter that rejects substantially all the wavelengths outside the identified spectral region. This region may be within the normal color extent of the colors or may be in the infra-red or ultra-violet.

Figure 6:
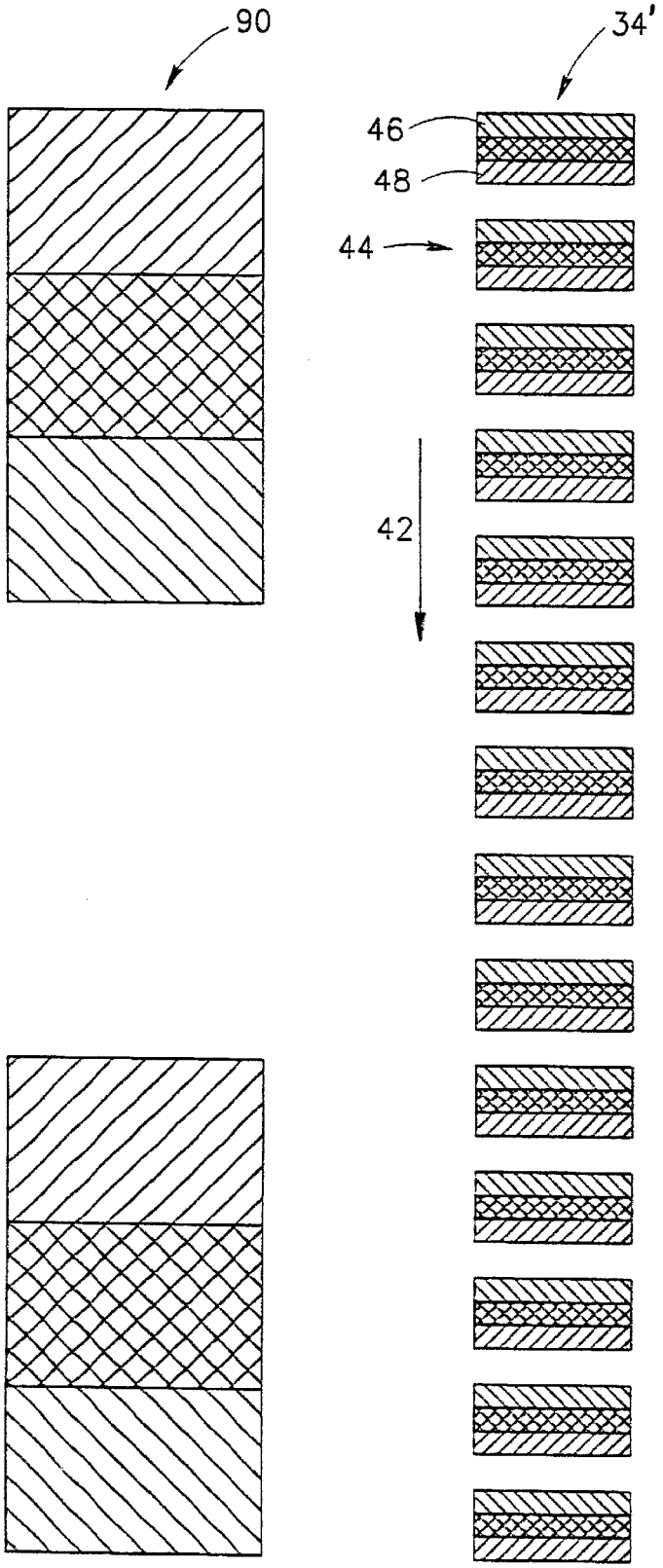
FIG. 6 schematically shows two alternative patterns, useful for carrying out a method in accordance with a preferred embodiment of the invention.

Alternatively, when printing for registration and/or scaling correction is performed in two colors, a different patterns may be used for the "reference" and for the other pattern. FIG. 6, shows a reference pattern 90, side by side with pattern 34', similar to that of FIG. 2A, that is more sensitive to misalignment. When the two patterns of the separations are registered, the average density and hue of the two patterns is the same. Both vary with misalignment but to different degrees, with the pattern on the left being less sensitive than that on the right. It should be noted that when alignment is achieved, both patterns have the same density and hue, such that the fact that both vary with misalignment does not deteriorate the accuracy of the final alignment. Such systems can also be used to correct scaling errors, however, more iterations may be necessary.

Alternatively, the alignment systems of the present invention can be used as an aid to alignment of ordinary plate printing presses in which separations are printed serially on a stack of pages. In this case, the pattern of the reference separation in FIGS. 1A, 2A and 2B (or 3A and 3B) is printed along the margin of the image for a first, reference separation. The entire run of pages is printed for this separation. The other separations are then printed serially, as in the prior art. In a preferred embodiment of the invention, the pattern of the other (non-reference) separation of FIGS. 1A, 2A and 2B (or 3B) are printed along the margin, such that when any one separations is aligned with the reference separation, the print of FIGS. 1A, 2A and 2B (or 3A and 3B) is printed along the margin.

The second separation is then aligned using the appropriate system described above. After such alignment, the entire run of pages (except for some pages to be used later to register the other separations) is printed with the second separation. In one preferred embodiment of the invention different colors are used for aligning the separations. In another preferred embodiment of the invention, the color of the reference separation is used for registration. The reference color is then removed and replaced by the desired color for the second separation.

The third separation is aligned with the reference separation in the same manner, utilizing some of the reserved pages printed with the reference separation. Then, the pages printed with the first and second separations are printed with the aligned third separation.

Subsequent separations are preferably aligned and printed in the same manner.

Although, in preferred embodiments of the invention, an in-line densitometer is used and an automatic registration adjustment is made, as described above, it is also possible for the densities to be measured manually and/or the adjustments to be made manually in response to these measurements. This is especially true of plate printing systems in which the position adjustments are normally made by turning adjustment knobs and/or for correction of misalignment and/or scaling in the direction perpendicular to the process direction. In a preferred embodiment of the invention, these adjustments are made automatically.

During a registration procedure, the registration and/or scale algorithms may successfully be completed for a given separation while necessitating further iterations for another separation. In other words, the registration algorithm may not converge for all the separations during the same iteration. For those separations that are registered earlier than others, the measurements and adjustments are preferably continued for all the separations to improve their registration to the extent possible.

In some preferred embodiments of the present invention, the procedure is conducted based only on measured optical densities. The algorithm applied in this case is much the same as the algorithm described above except for the fact that the optical density does not vary linearly with the imposed offset.

In the description and claims of the present application each of the verbs, "comprise" and "include" and conjugates thereof are used to convey that the object or objects of the verb are not necessarily a listing of all the components, elements or parts of the subject or subjects of the verb.

While the invention has been described with reference to certain preferred embodiments, various modifications will be readily apparent to and may be readily accomplished by persons skilled in the art without departing from the spirit and the scope of the above teachings. Various embodiments of the invention have been described having specific features. It should be understood that features of the various embodiments may be combined, where appropriate and features which are described above may be omitted, in some preferred embodiments of the invention. Therefore, it is understood that the invention may be practiced other than as specifically described herein without departing from the scope of the following claims:

What is claimed is:

1. A method for registration of print separations in a printer comprising:

(a) printing a first pattern, for which at least one image characteristic varies with misregistration in either direction of misregistration to a first degree, using said at least one first and second separations;

(b) printing a second pattern, for which said at least one image characteristic varies with misregistration, in either direction of misregistration, to a second degree, using at least one of the first and second separations, said second degree being smaller in both directions, than said first degree, or zero;

(c) determining said at least one image characteristic for the first and second patterns; and (d) correcting the mutual registration of said at least one first and second separations responsive to a difference in the determined at least one image characteristic for the first and second patterns.

2. A method according to claim 1 and including: repeating at least (b)–(d) for a third separation in place of said second separation.

3. A method according to claim 1 wherein said second pattern is printed utilizing both said first and second separations.

4. A method according to claim 1 in which the characteristic comprises a dot area.

5. A method according to claim 1 in which the characteristic comprises a hue.

6. A method according to claim 4 wherein said dot area is determined from a measurement of optical density.

7. A method according to claim 1 in which the characteristic comprises an average optical density of the pattern.

8. A method according to claim 1 wherein the second pattern is printed using only one separation.

9. A method according to claim 1 wherein the first and second separations are printed in a same color.

10. A method according to claim 1 wherein the first and second separations are printed in different colors.

11. A method according to claim 1 in which the characteristic comprises an extent.

12. A method according to claim 11 wherein the first pattern comprises a series of lines having a given spacing pattern printed using said first separation and wherein the second pattern comprises a series of lines having said given spacing pattern and wherein, in the absence of misregistration, some of said lines are printed utilizing said first separation and some of said lines are printed utilizing said second separation.

13. A method according to claim 1 wherein the characteristic of the second pattern does not vary with misregistration.

14. A method according to claim 13, in which:

the first pattern comprises at least one first rectangle printed by said first separation and having a given extent and at least one second rectangle printed by said second separation having a smaller extent than said first rectangle in at least one direction, said at least one second rectangle being completely within the first rectangle, such that the characteristic is not a function of misregistration of the separations; and the second pattern comprises at least one third rectangle printed by said first separation and at least one fourth rectangle printed by said second separation partially overlapping said third rectangle, the extent of said partially overlapping rectangles having said given extent when the separations are registered.

15. A method according to claim 9 in which:

the second pattern comprises at least one first rectangle printed by said first separation having a first given extent and at least one second rectangle printed by said second separation having said first given extent partially overlapping said first rectangle, the extent of said partially overlapping rectangles providing a pattern for which said characteristic varies relatively weakly with misregistration of the separations; and the first pattern comprises at least one third rectangle printed by said first separation and at least one fourth rectangle printed by said second separation partially overlapping said third rectangle, the extent of said partially overlapping rectangles providing the same value of the characteristic as for the second pattern when the separations are registered, wherein the extent of the third and fourth rectangles is much smaller than the first given extent, such that the characteristic of the first pattern is much more sensitive to misregistration than is the second pattern.

16. A method according to claim 10 and including:

identifying a spectral region for which said different colors have a substantially equal absorption; and utilizing a characteristic of said patterns in said spectral region in registering the separations.

17. A method according to claim 1 and including printing a plurality of said patterns and utilizing an average value of the characteristic in correcting the registration.

18. A method according to claim 1, including:

printing a plurality of said patterns;

determining a functional fit to variations in said characteristics; and utilizing a zeroth order term in said functional fit to correct the registration.

19. A method according to claim 17 wherein correcting said registration includes correcting scale differences between the separations, and including utilizing a variation in said characteristic in correcting scale differences between the patterns.

20. A method according to claim 1 wherein correcting said registration includes correcting scale differences between the separations and including printing a plurality of said patterns and utilizing a variation in said characteristic in correcting scale differences between the patterns.

21. A method according to claim 19 wherein the variation used to correct scale differences is a first order variation of the characteristic.

22. A method according to claim 1 wherein the first and second patterns comprise a plurality of repeating subpatterns and wherein an average value of said characteristic over the extent of the pattern is utilized in correcting the registration.

23. A method according to claim 1 wherein the printer prints said separations without a change of printing plates.

24. A method according to claim 1 wherein the printer is an electrostatic printer.

25. A method according to claim 24 wherein the electrostatic printer is an electrophotographic printer.

26. A method according to claim 25 wherein the printer utilizes liquid toner to print.

27. A method according to claim 25 wherein the printer utilizes powder toner to print.

28. A method according to claim 1 wherein an intermediate transfer member is utilized to transfer the separations between an image forming surface, on which the separations are formed, and a substrate.

29. A method according to claim 28 wherein the intermediate transfer member is heated.

30. A method according to claim 1 wherein the patterns are used only for registration and are not printed together with an image for which registration is desired.

31. A method according to claim 1 wherein said registration serves to align the printer and wherein subsequent images, different from the patterns, are printed with the same printer alignment.

32. A method according to claim 1 wherein the printer uses dedicated plates for each separation.

33. A method according to claim 32 wherein the printer utilizes printing ink to print the patterns.

34. A method according to claim 1 wherein a same printing engine is used to print the separations.

35. A method according to claim 1 wherein different printing engines are used to print the separations.

36. A method according to claim 1 and including:

repeating at least (a)–(c) after correcting the registration in accordance with (d).

37. A method according to claim 1 and including:

iteratively repeating at least (a)–(c) after correcting the registration in accordance with (d), until said difference is below a given value.

38. A method according to claim 20 wherein the variation used to correct scale differences is a first order variation of the characteristic.

* * * * *